US008813537B1

(12) United States Patent
Diego

(10) Patent No.: US 8,813,537 B1
(45) Date of Patent: Aug. 26, 2014

(54) VEHICLE BODY REPAIR DEVICE

(71) Applicant: Perfecto D. Diego, Los Angeles, CA (US)

(72) Inventor: Perfecto D. Diego, Los Angeles, CA (US)

( * ) Notice: Subject to any disclaimer, the term of this patent is extended or adjusted under 35 U.S.C. 154(b) by 0 days.

(21) Appl. No.: 14/032,990

(22) Filed: Sep. 20, 2013

(51) Int. Cl.

| | |
|---|---|
| ***B21D 13/02*** | (2006.01) |
| ***B25B 33/00*** | (2006.01) |
| ***B25D 17/00*** | (2006.01) |
| ***B21D 1/12*** | (2006.01) |

(52) U.S. Cl.
CPC . *B21D 1/12* (2013.01); *Y10S 72/705* (2013.01)
USPC ..... 72/453.16; 72/375; 72/446; 72/705; 173/122; 173/205; 173/217

(58) Field of Classification Search
CPC ..... B21J 7/30; B21D 1/06; B25D 17/06; B25B 33/00; H01R 43/0427
USPC ..... 173/122, 162.2, 170, 217; 72/453.16, 72/453.17, 430, 705, 707
See application file for complete search history.

(56) References Cited

U.S. PATENT DOCUMENTS

| | | | | |
|---|---|---|---|---|
| 1,940,738 | A * | 12/1933 | Anderson | 72/456 |
| 2,378,871 | A | 6/1945 | Stephens | |
| 4,653,167 | A | 3/1987 | Mullins | |
| 4,754,637 | A * | 7/1988 | O'Dell | 72/430 |
| D314,126 | S | 1/1991 | Moore | |
| 5,119,667 | A * | 6/1992 | Hollis et al. | 72/453.16 |
| 5,329,802 | A | 7/1994 | Nunez | |
| 5,730,021 | A * | 3/1998 | Johnson | 72/705 |
| D396,620 | S | 8/1998 | Sung | |
| 6,439,025 | B1 | 8/2002 | Peters | |
| 6,612,144 | B2 | 9/2003 | Domino | |
| 8,256,527 | B2 * | 9/2012 | Wu | 173/122 |
| 8,485,276 | B2 * | 7/2013 | Wei | 173/217 |

* cited by examiner

*Primary Examiner* — David B Jones

(57) ABSTRACT

A vehicle body repair device repairs buckled or dented sheet metal to a desired condition. The device includes a housing and a first head coupled to the housing. The first head has an outer surface facing away from the housing. A second head is coupled to a handle. The second head has an outer surface facing away from the handle. A reciprocating unit is coupled to and positioned in the housing wherein the reciprocating unit urges the first head into repetitive contact with a sheet of material adjacent to the first head when the reciprocating unit is activated. Thus, the sheet of material is urged to conform to a shape defined by the outer surface of the first head and the outer surface of the second head when the sheet of material is positioned between the first head and the second head while the reciprocating unit is activated.

17 Claims, 5 Drawing Sheets

VEHICLE BODY REPAIR DEVICE

BACKGROUND OF THE DISCLOSURE

Field of the Disclosure

The disclosure relates to repair tool devices and more particularly pertains to a new repair tool device for repairing buckled or dented sheet metal and restoring it to a desired condition.

SUMMARY OF THE DISCLOSURE

An embodiment of the disclosure meets the needs presented above by generally comprising a housing and a first head coupled to the housing. The first head has an outer surface facing away from the housing. A second head is coupled to a handle. The second head has an outer surface facing away from the handle. A reciprocating unit is coupled to and positioned in the housing wherein the reciprocating unit urges the first head into repetitive contact with a sheet of material adjacent to the first head when the reciprocating unit is activated. Thus, the sheet of material is urged to conform to a shape defined by the outer surface of the first head and the outer surface of the second head when the sheet of material is positioned between the first head and the second head while the reciprocating unit is activated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
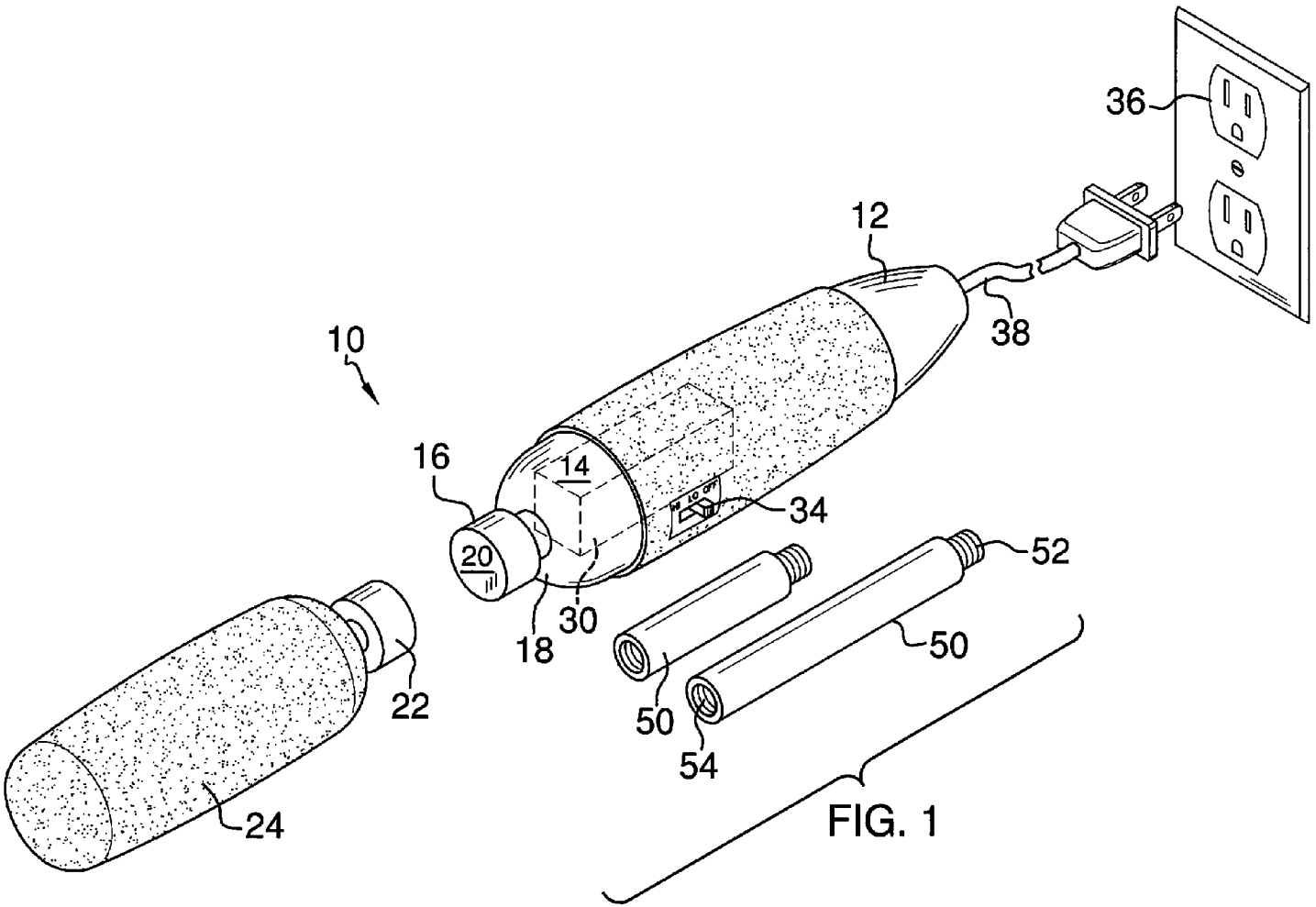
FIG. 1 is a top front side perspective view of a vehicle body repair device according to an embodiment of the disclosure.
Figure 2:
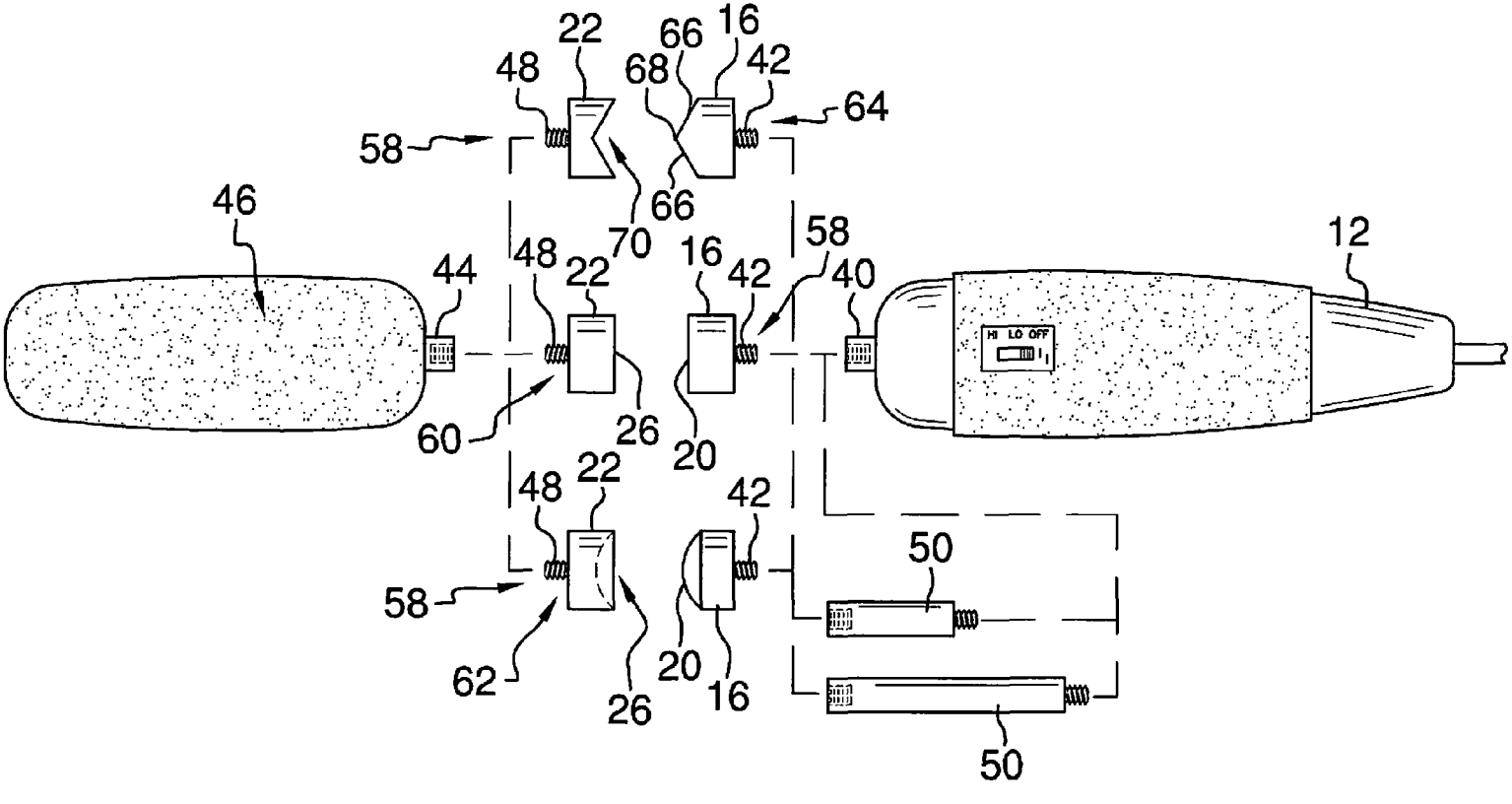
FIG. 2 is an exploded front view of an embodiment of the disclosure.
Figure 3:
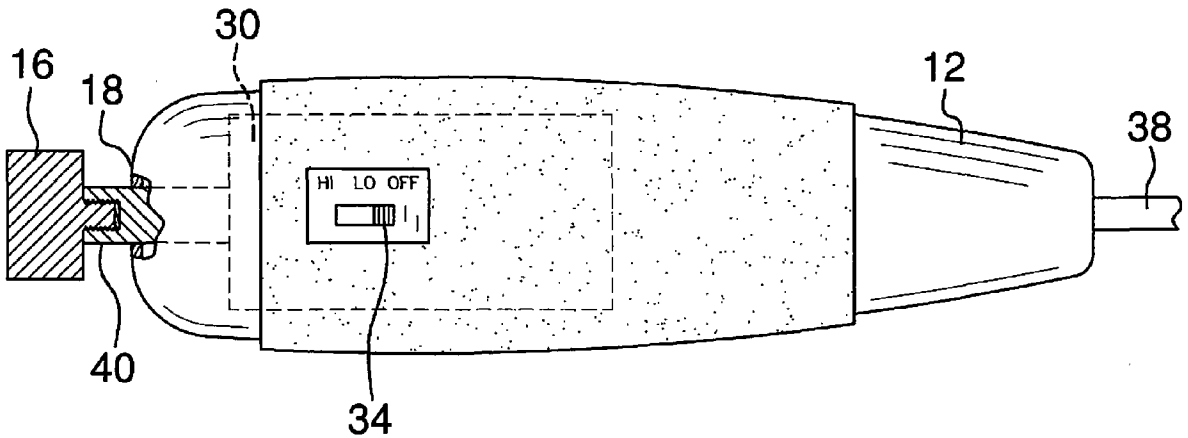
FIG. 3 is a partial cut-away front view of an embodiment of the disclosure.
Figure 4:
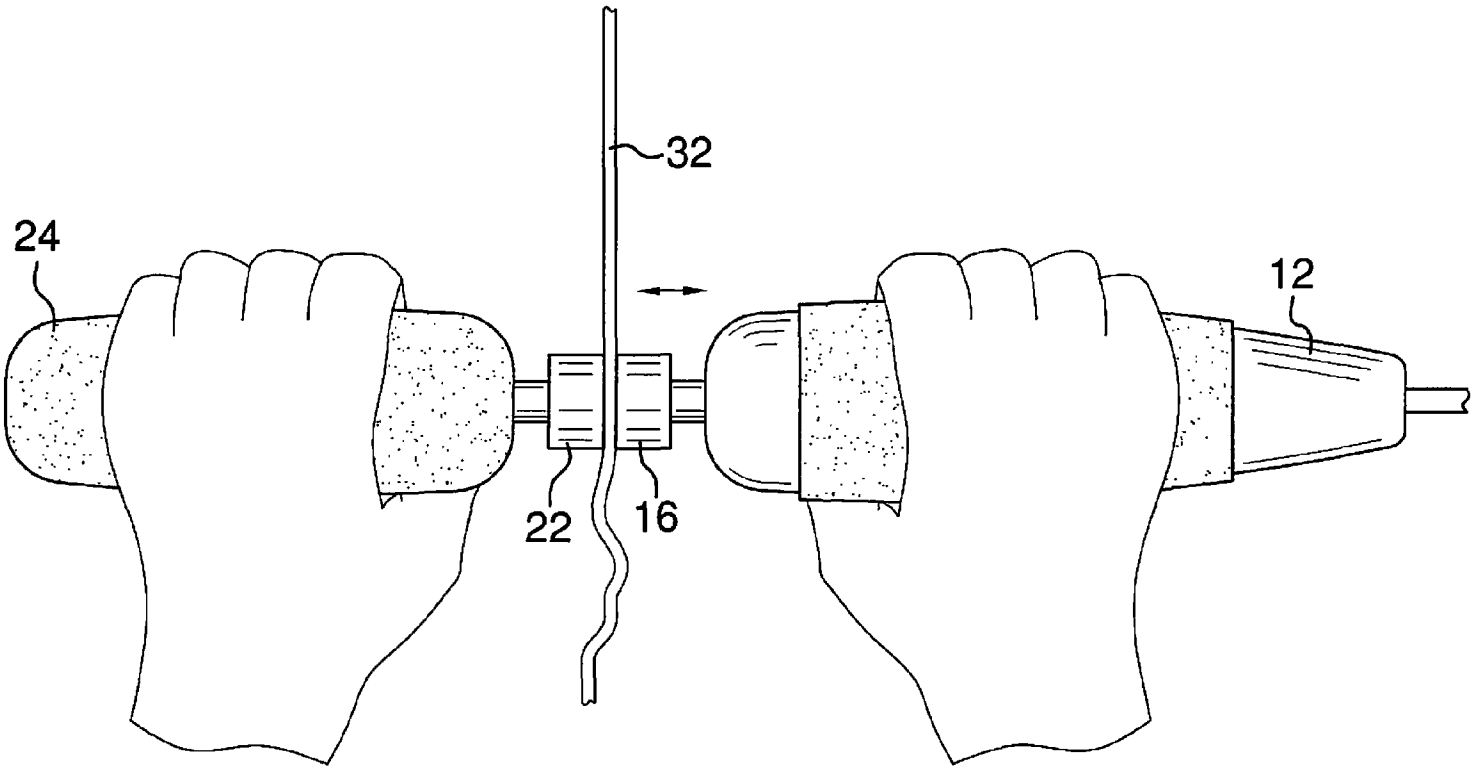
FIG. 4 is a top view of an embodiment of the disclosure in use.
Figure 5:
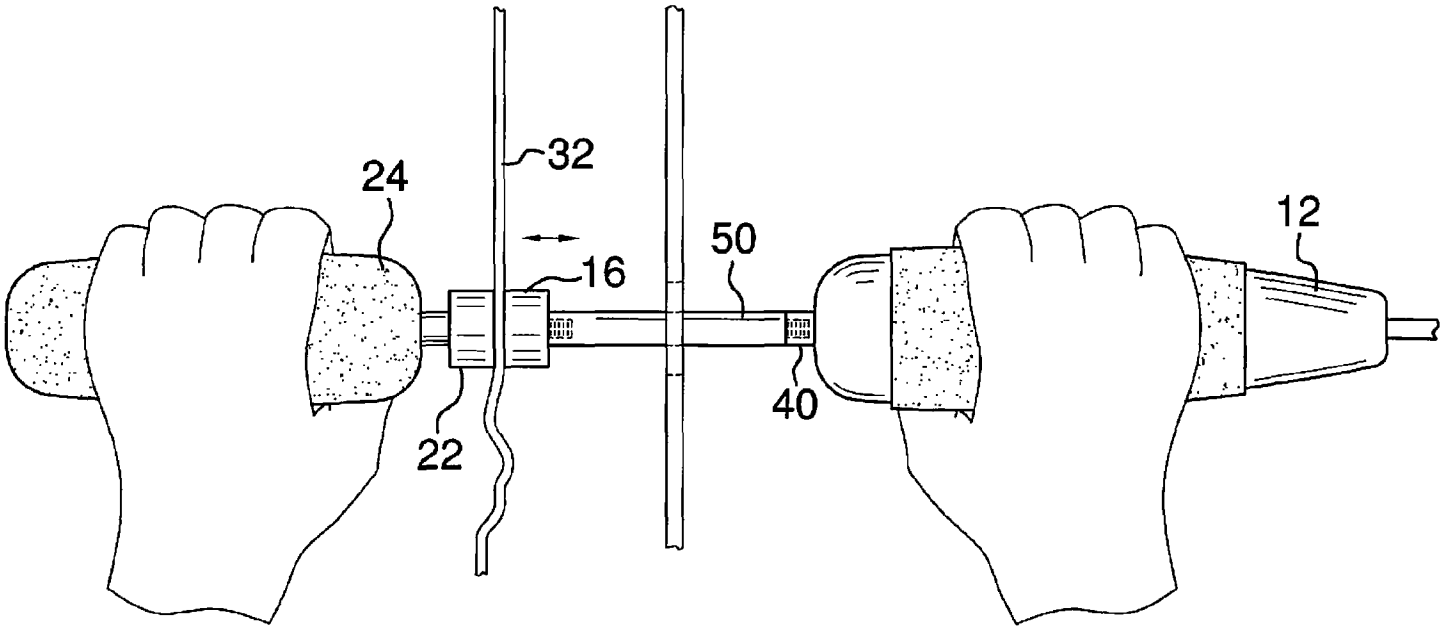
FIG. 5 is a top view of an embodiment of the disclosure in use.

With reference now to the drawings, and in particular to FIGS. 1 through 5 thereof, a new repair tool device embodying the principles and concepts of an embodiment of the disclosure and generally designated by the reference numeral 10 will be described.

As best illustrated in FIGS. 1 through 5, the vehicle body repair device 10 generally comprises a housing 12. The housing 12 may be elongated and tubular forming an outer surface 14 configured for being grasped firmly by a user. The outer surface 14 may be cushioned or padded. A first head 16 is coupled to the housing 12 such that the first head extends outwardly from a first end 18 of the housing 12. The first head 16 has an outer surface 20 facing away from the housing 12. The first head 16 is removably coupled to the housing 12. A second head 22 is coupled to an elongated handle 24. The handle 24 may also have a cushioned or padded surface 46 to facilitate firm grasping of the handle 24. The second head 22 has an outer surface 26 facing away from the handle 24. The outer surface 20 of the first head 16 and the outer surface 26 of the second head 22 are complimentary such that they substantially mate when positioned together against each other. A reciprocating unit 30 is coupled to and positioned in the housing 12. The reciprocating unit 30 is configured for urging the first head 16 into repetitive contact with a sheet of material 32, such as sheet metal, adjacent to the first head 16 when the reciprocating unit 30 is activated. Thus, the sheet of material 32 is urged to conform to a shape defined by the outer surface 20 of the first head 16 and the outer surface 26 of the second head 22 when the sheet of material 32 is positioned between the first head 16 and the second head 22 while the reciprocating unit 30 is activated. The reciprocating unit 30 may have multiple speeds controlled by a switch 34 coupled to and positioned on the housing 12. The switch 34 is positioned between the reciprocating unit 30 and a power source 36 which may include a power cord 38.

A receiver 40 is coupled to the housing 12. The receiver 40 may be threaded. A connector 42 is coupled to and extends from the first head 16 opposite the outer surface 20. The connector 42 is selectively engageable to the receiver 40 wherein the first head 16 is removably couplable to the housing 12. Similarly, a socket 44 is coupled to the handle 24 and a projection 48 is coupled to and extends from the second head 22. The projection 48 is selectively engageable to the socket 44 wherein the second head 22 is removably couplable to the handle 24.

A plurality of extensions 50 may be provided. Each extension 50 has a first end 52 selectively couplable to the connector 42 or the socket 44. Each extension 50 has a second end 54 selectively couplable to the first head 16 or the second head 22 wherein the extension 50 is selectively positionable between the second head 22 and the handle 24. Similarly, the first end 52 of each extension 50 is selectively couplable to the receiver 40 and the second end 54 of the extension 50 is selectively couplable to the first head 16. Thus, each extension 50 is selectively positionable between the first head 16 and the housing 12 if so desired. The extensions 50 may be provided in varied lengths to facilitate positioning of the first head 16 and second head 22 in desired positions while comfortably grasping the housing 12 and the handle 24 on opposite sides of the sheet of material 32.

The first head 16 and the second head 22 define one of a plurality of interchangeable sets 58. A first set 60 is provided wherein each of the outer surface 20 of the first head 16 of the first set 60 and the outer surface 26 of the second head 22 of the first set 60 is planar. A second set 62 is provided wherein the outer surface 20 of the first head 16 of the second set 62 is convex and the outer surface 26 of the second head 22 of the second set 62 is concave. A third set 64 may be provided wherein the outer surface 20 of the first head 16 of the third set 64 is a pair of flat planar sections 66 extending from a ridge 68 and the outer surface 26 of the second head 22 of the third set 64 is a V-shaped groove 70. Thus, by selecting a desired set 58, the sheet of material 32 may be worked into a desired shape.

In use, the sets 58 of first heads 16 and second heads 22 may be selected and used with the housing 12 and handle 24 to restore damaged sheet metal to an original shape.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A vehicle body repair device comprising:

a housing;

a first head coupled to said housing, said first head having an outer surface facing away from said housing;

a handle;

a second head coupled to said handle, said second head having an outer surface facing away from said handle;

a reciprocating unit coupled to and positioned in said housing wherein said reciprocating unit is configured for urging said first head into repetitive contact with a sheet of material adjacent to said first head when said reciprocating unit is activated wherein the sheet of material is urged to conform to a shape defined by said outer surface of said first head and said outer surface of said second head when the sheet of material is positioned between said first head and said second head while said reciprocating unit is activated;

said outer surface of said first head and said outer surface of said second head being complimentary; and said outer surface of said first head and said outer surface of said second head each being planar.

2. The device of claim 1, further comprising said first head and said second head defining a first of a pair of interchangeable first and second head sets, wherein a second of said pair of interchangeable first and second heads sets comprises an outer surface of said first head being convex and said outer surface of said second head being concave.

3. The device of claim 1, further comprising said first head and said second head defining a first of a pair of interchangeable first and second head sets, wherein a second of said pair of interchangeable first and second heads sets comprises said outer surface of said first head being a pair of flat sections extending from a ridge, said outer surface of said second head being a V-shaped groove.

4. The device of claim 1, further comprising said first head being removably coupled to said housing.

5. The device of claim 1, further comprising:

a receiver coupled to said housing;

a connector coupled to and extending from said first head, said connector being selectively engageable to said receiver wherein said first head is removably couplable to said housing.

6. The device of claim 5, further comprising an extension having a first end selectively couplable to said receiver, said extension having a second end selectively couplable to said first head wherein said extension is selectively positionable between said first head and said housing.

7. The device of claim 6, further comprising said extension being one of a plurality of interchangeable extensions selectively positionable between said first head and said housing.

8. The device of claim 1, further comprising said first head and said second head defining one of a plurality of interchangeable first and second head sets.

9. The device of claim 1, further comprising:

a socket coupled to said handle; and a projection coupled to and extending from said second head, said projection being selectively engageable to said socket wherein said second head is removably couplable to said handle.

10. The device of claim 9, further comprising an extension having a first end selectively couplable to said socket, said extension having a second end selectively couplable to said second head wherein said extension is selectively positionable between said second head and said handle.

11. A vehicle body repair device comprising:

a housing;

a first head coupled to said housing, said first head having an outer surface facing away from said housing, said first head being removably coupled to said housing;

a handle;

a second head coupled to said handle, said second head having an outer surface facing away from said handle, said outer surface of said first head and said outer surface of said second head being complimentary;

a reciprocating unit coupled to and positioned in said housing wherein said reciprocating unit is configured for urging said first head into repetitive contact with a sheet of material adjacent to said first head when said reciprocating unit is activated wherein the sheet of material is urged to conform to a shape defined by said outer surface of said first head and said outer surface of said second head when the sheet of material is positioned between said first head and said second head while said reciprocating unit is activated;

a receiver coupled to said housing;

a connector coupled to and extending from said first head, said connector being selectively engageable to said receiver wherein said first head is removably couplable to said housing;

a socket coupled to said handle;

a projection coupled to and extending from said second head, said projection being selectively engageable to said socket wherein said second head is removably couplable to said handle; and a plurality of extensions, each said extension having a first end selectively couplable to said socket, each said extension having a second end selectively couplable to said second head wherein said extension is selectively positionable between said second head and said handle, said first end of each said extension being selectively couplable to said receiver, said second end of said extension being selectively couplable to said first head wherein each said extension is selectively positionable between said first head and said housing; and wherein said first head and said second head define one of a plurality of interchangeable sets, a first set being provided wherein each of said outer surface of said first head of said first set and said outer surface of said second head of said first set is planar, a second set being provided wherein said outer surface of said first head of said second set is convex and said outer surface of said second head of said second set is concave, a third set being provided wherein said outer surface of said first head of said third set is a pair of flat sections extending from a ridge and said outer surface of said second head of said third set is a V-shaped groove.

12. A vehicle body repair device comprising:

a housing;

a first head coupled to said housing, said first head having an outer surface facing away from said housing;

a handle;

a second head coupled to said handle, said second head having an outer surface facing away from said handle, said first head and said second head defining one of a plurality of interchangeable first and second head sets;

a reciprocating unit coupled to and positioned in said housing wherein said reciprocating unit is configured for urging said first head into repetitive contact with a sheet of material adjacent to said first head when said reciprocating unit is activated wherein the sheet of material is urged to conform to a shape defined by said outer surface of said first head and said outer surface of said second head when the sheet of material is positioned between said first head and said second head while said reciprocating unit is activated.

13. The device of claim 12, further comprising:

a receiver coupled to said housing;

a connector coupled to and extending from said first head, said connector being selectively engageable to said receiver wherein said first head is removably couplable to said housing.

14. The device of claim 13, further comprising an extension having a first end selectively couplable to said receiver, said extension having a second end selectively couplable to said first head wherein said extension is selectively positionable between said first head and said housing.

15. The device of claim 14, further comprising said extension being one of a plurality of interchangeable extensions selectively positionable between said first head and said housing.

16. The device of claim 12, further comprising:

a socket coupled to said handle; and a projection coupled to and extending from said second head, said projection being selectively engageable to said socket wherein said second head is removably couplable to said handle.

17. The device of claim 16, further comprising an extension having a first end selectively couplable to said socket, said extension having a second end selectively couplable to said second head wherein said extension is selectively positionable between said second head and said handle.

* * * * *